US007942690B2

(12) United States Patent
Berkobin et al.

(10) Patent No.: US 7,942,690 B2
(45) Date of Patent: May 17, 2011

(54) CABLE POSITIONER

(75) Inventors: Eric Berkobin, Woodstock, GA (US); Fred Blumer, Atlanta, GA (US); Randy Holmes, Atlanta, GA (US)

(73) Assignee: HTI IP, LLC, Atlanta, GA (US)

( * ) Notice: Subject to any disclaimer, the term of this patent is extended or adjusted under 35 U.S.C. 154(b) by 0 days.

(21) Appl. No.: 12/606,001

(22) Filed: Oct. 26, 2009

(65) Prior Publication Data

US 2010/0105241 A1 Apr. 29, 2010

Related U.S. Application Data

(60) Provisional application No. 61/108,189, filed on Oct. 24, 2008.

(51) Int. Cl.
*H01R 13/58* (2006.01)

(52) U.S. Cl. ..... 439/456

(58) Field of Classification Search ..... 439/456, 439/459, 468, 470, 471
See application file for complete search history.

(56) References Cited

U.S. PATENT DOCUMENTS

| | | | | |
|---|---|---|---|---|
| 3,032,740 | A * | 5/1962 | Von Hoorn | 439/694 |
| 5,676,568 | A * | 10/1997 | Weber | 439/694 |
| 5,848,916 | A * | 12/1998 | Huang | 439/619 |
| 6,375,493 | B1 * | 4/2002 | Lin | 439/457 |

* cited by examiner

*Primary Examiner* — Briggitte R Hammond
*Assistant Examiner* — Larisa Z Tsukerman
(74) *Attorney, Agent, or Firm* — John L. Doughty

(57) ABSTRACT

A cable positioner is formed integrally with a connector and/or a plug, or is shaped and sized to matingly engage a connector and/or a plug. The connector cable positioner can define at least one groove. The groove is sized to secure the cable in a desired position and direct it in a desired direction. The positioner may define at least one retaining tab, or lip, at the extent of at least one groove wall to produce an interference fit with the cable when pushed through the retaining tab, while surrounding the groove enough to effectively create a groove wall more than 180 degrees around the grove to retain the cable in the groove. The at least one tab can pinch, or otherwise secure, at least a portion of the cable to hold the cable in desired position and direction.

5 Claims, 3 Drawing Sheets

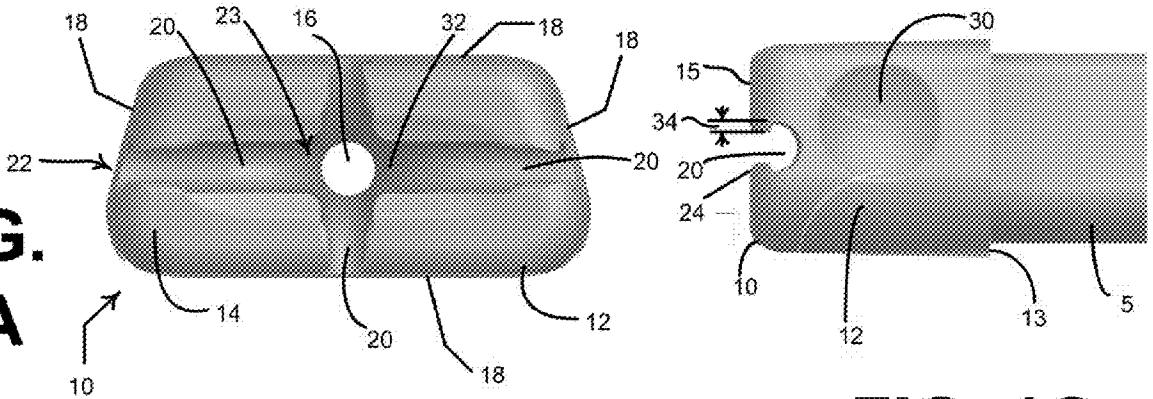
FIG. 1A
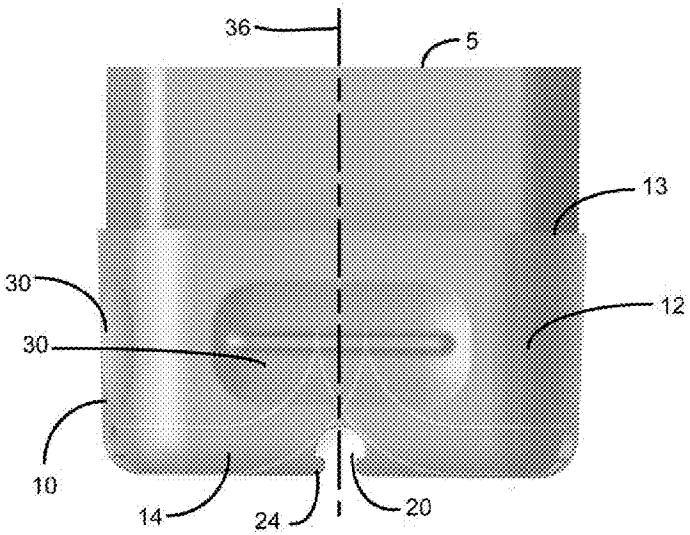
FIG. 1B
FIG. 1C

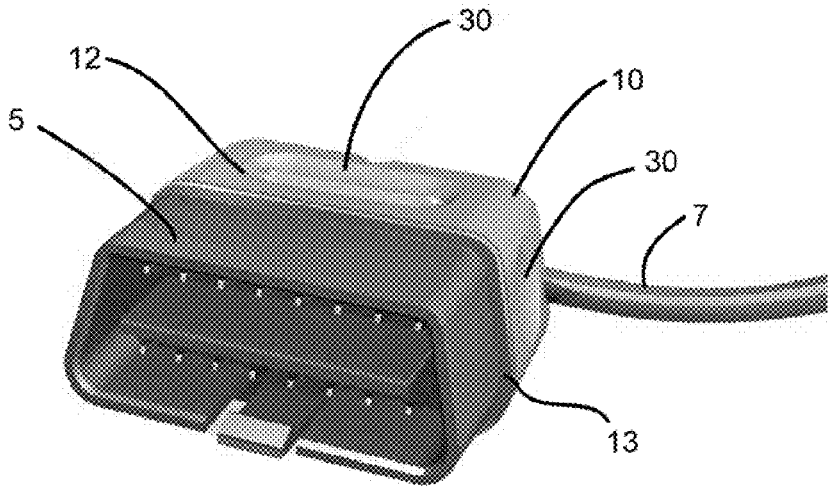
FIG. 3A
FIG. 3B
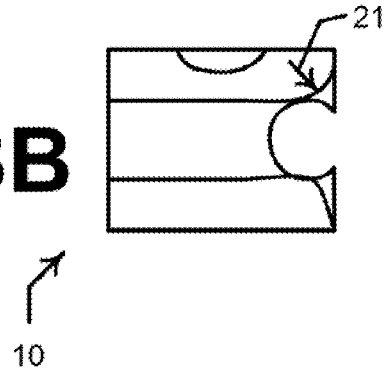

CABLE POSITIONER

CROSS REFERENCE TO RELATED APPLICATION

This application claims priority under 35 U.S.C. §119(e) to U.S. Provisional Patent Application entitled "Cable Positioner" filed on Oct. 24, 2008, having Ser. No. 61/108,189 to Berkobin, et. al.

FIELD OF THE INVENTION

The invention relates generally to a cable positioner, and more particularly to a connector cable positioner for use with a variety of connectors, including an on-board diagnostics and telematics system connector.

BACKGROUND

On-board diagnostics ("OBD") is a computer-based system designed to monitor the performance of some of a vehicle engine's major components including those responsible for controlling emissions. The Environmental Protection Agency ("EPA") requires vehicle manufacturers to install OBD systems for emission control on their light-duty automobiles and trucks beginning with model year 1996. OBD systems (e.g., computer, microcontrollers, and sensors) monitor the vehicle's emission control systems to detect any malfunction or deterioration that causes emissions to exceed EPA-mandated thresholds. One such system, for example, is an oxygen sensor located in a vehicle's exhaust system. The EPA requires that all information monitored or calculated by OBD systems be made available through a standardized, serial 16-pin connector referred to as the OBD-II connector—the standard to which the EPA mandated new cars conform beginning Jan. 1, 1996, is the OBD-II standard. All physical and electrical characteristics of this connector are standard for all vehicles sold in the United States after Jan. 1, 1996. The EPA also mandates that, when emission thresholds are exceeded, a vehicle's OBD system store diagnostic information in the vehicle's central computer so that it can be used during diagnosis and repair.

OBD-II systems monitor a wide range of data that indicate the performance of the host vehicle. For example, this data can be analyzed to determine the vehicle's emission performance. In addition to emissions, other parameters that an OBD-II system monitors include vehicle speed, mileage, engine temperature, and intake manifold pressure. OBD-II systems also query manufacturer-specific data, such as data relating to the vehicle's engine, transmission, brakes, alarm, and entertainment systems. OBD-II systems also make available at the OBD-II connector monitor codes called diagnostic trouble codes ("DTCs") that indicate a mechanical or electrical problem with the vehicle. DTCs are the codes that typically light a vehicle's 'service engine soon' light, or malfunction indicator light ("MIL").

The OBD-II specification provides for a standardized hardware interface—the 16-pin (2×8) J1962 electrical connector, or the ODB-II connector. The J1962 defines the pin arrangement ("pin outs") of the connector and leaves some pins unspecified for use at the vehicle original equipment manufacturer's ("OEM") discretion.

In addition to the OBD-II systems, most vehicles manufactured after 1996 have electronic control units ("ECUs") that control internal electromechanical actuators. Examples include ECUs that control fuel-injector pulses, spark-plug timing, and anti-lock braking systems. Most ECUs transmit status and diagnostic information over a shared, standardized electronic buss in the vehicle. The buss effectively functions as an on-board computer network with many processors, each of which transmits and receives data. When a vehicle is serviced, data from the standardized buss can be queried using external engine-diagnostic equipment (commonly called scan tools) that connects to the OBD-II connector, which is typically located under the vehicle's dashboard on the driver's side. Data transferred through the connector to the scan tools yields data that identify a status of the vehicle and whether or not a specific component of the vehicle has malfunctioned. This makes the service process more efficient and cost-effective.

SUMMARY

The application relates generally to a cable positioner for facilitating the routing of a cable coupled to a connector. In one aspect, the connector's cable positioner can be formed integrally with the connector and/or a plug. In another aspect, the connector's cable positioner can have a body shaped and sized so that the positioner can matingly engage a connector and/or a plug.

The cable positioner comprises at least one groove in a distal end of the positioner. In one aspect, at least a portion of the at least one groove can extend outwardly and away from the longitudinal axis of the body of the positioner as the groove extends toward a peripheral edge of the distal end of the body. For purposes of discussion of the aspect, the longitudinal axis of the body nominally coincides with an axis of the cable where it couples to the connector.

In another aspect, each at least one groove can comprise a means for holding at least a portion of the cable in a fixed position such that axis of the holding means forms an angle with the longitudinal axis of the positioned body. In still another aspect, at least a portion of the groove can have a cross-sectional area smaller than the cross-sectional area of cable it is designed to retain. In this aspect, the interference fit between the smaller cross sectional area of the connector and the slightly larger area of the cable tends to hold a portion of the cable in the groove. In yet another aspect, the groove walls may define at least one tab groove to pinch, or otherwise hold, at least a portion of the cable in the groove. The positioned can be formed from a deformable material so that a cable jacket causes the groove walls to deflect as a user presses the cable into the positioned groove.

In another aspect, the positioner is integrated with the connector of a cable for interaction with an OBD connector.

In another aspect, the positioner cooperates with an existing cable connector that has been designed for interaction with an OBD connector. Thus, the connector aspect can be an add-on to an existing OBD, OBD II, or any other electrical connector. For example, a cable positioned with grooves and the other aspects described above could be used with home entertainment connectors, such as, for example, an HDMI connecter, a USB cable connected to a computer, an optical cable connecter, or a speaker wire connecter, etc. Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE FIGURES

These and other features of the preferred embodiments of the invention will become more apparent in the detailed description in which reference is made to the appended drawings wherein:

FIG. 1A is front elevational view of a cable positioner, according to one aspect.

FIG. 1B is top plan view of the cable positioner of FIG. 1A showing a plurality of grooves.

FIG. 1C is side elevational view of the cable positioner of FIG. 1A showing a plurality of grooves.

FIG. 3A is rear perspective view of a cable positioner, an OBD connector, and a connector cable, according to another aspect.

FIG. 3B illustrates a section view a positioner cut through the axis of a bore of the positioner.

DETAILED DESCRIPTION

Figure 2A:
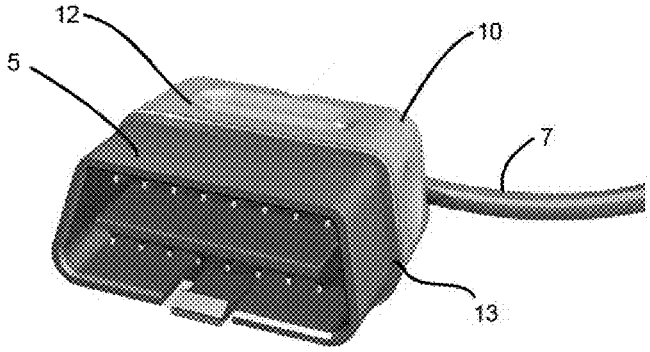
FIG. 2A is rear perspective view of a cable positioner, an OBD connector, and a connector cable, according to one aspect.
Figure 2B:
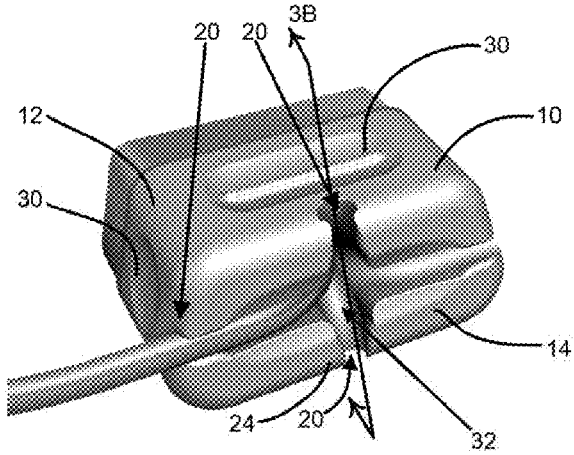
FIG. 2B is front perspective view of the cable positioner of FIG. 2A.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a connector" can include two or more such connectors unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the term "connector" refers to any of the various devices for connecting one object to another, including, for example and without limitation, OBD and OBD-II system connectors, electrical plugs, sockets, and the like.

As used herein, the term "OBD connector" refers to any standardized, serial 16-pin electrical connector configured for connecting external computer, diagnostic, and telematics equipment to a vehicle, including OBD connectors, OBD-II connectors, any later generations of OBD system connectors, and the like.

A connector cable positioner 10 is provided, according to various aspects. In one aspect, as illustrated in FIGS. 1A, 1B, and 1C, cable positioner 10 may include at least one of: a body 12 having a longitudinal axis, a proximal end 13 configured for engaging a connector, a distal end 14, a bore 16 defined in the positioner for providing passage of the cable through the positioner, and at least one groove 20.

Body 12 is not limited to a size and shape. In one aspect, the body can be formed integrally with connector 5. In another aspect, however, the body can be formed separately from connector 5. In this aspect, body 12 can be sized and shaped so that at least a portion of the proximal end 13 of the body can be inserted onto, and/or attached to, or otherwise engage with a portion of the connector. In still another aspect, the height of the body can be between about 10 and 30 mm, the width of the body 12 can be between about 30 and 60 mm, and the depth of the body can be between about 10 and 30 mm.

In one aspect, body 12 can be formed from materials such as, for example and without limitation, plastic, rubber, polypropylene, and the like. In another aspect, the body can be formed from the same material as connector 5, however, the body can also be formed from other materials. In yet another aspect, body 12 can define at least one grip area 30. Grip area 30 can be a recessed area in body 12 configured to provide a user of positioner 10 a means to grip the positioner and the connector 5.

In another aspect, referring again to FIG. 1A, body 12 may define bore 16 to facilitate passage through positioner 10 of a portion of a cable 7 shown in FIG. 2A attached to connector 5. Bore 16 in FIG. 1A, in one aspect, can have a cross-sectional area the same as, or greater than, the cross-sectional area of cable 7 shown in FIG. 2A. In yet another aspect, the bore can extend through body 12 from proximal end 13 to distal end 14, such that when positioner 10 is inserted onto, attached to, or otherwise coupled with, connector 5, cable 7 can extend through the positioner.

Body 12 may define at least one groove 20 in a portion of distal end 14. In one aspect, groove 20 can extend between bore 16 and a peripheral edge 18 of distal end 14. In another aspect, a flared, or tapered transition 32 between the opening of bore 16 and groove/channel, or grooves/channels 20, facilitates conformance with bending tolerances for cable 7 coupled to connector 5 and extending along the bore's axis out from bore 16 and away from the connector.

In another aspect, body 12 can define the at least one groove 20 so that the groove's axis and the longitudinal axis of body 12 form substantially a ninety degree angle.

In still another aspect, the at least one groove can extend along an arcuate path outwardly and away from a center line (axis) of the bore 16 when moving from the proximal end 23 toward the distal end 22 of the at least one groove 20. In this aspect, the arcuate path forms a flared transition portion 32 between the preferably cylindrical bore 16 and the one, or more, grooves 20. The transitional portion 32 has an radius 21

(i.e., a bend radius shown in the section view of FIG. 3B) that is configured to reduce stress as the cable bends from being parallel to the axis of bore 16 to being substantially perpendicular to the axis of the bore along the axis of groove 20. In one aspect, the bend radius can be between about 5 and 20 mm. In another aspect, the bend radius of the at least one groove 20 can be changed based upon the properties of the cable that will be positioned in the groove, as known in the art. The appropriate bend radius of the at least one groove can prevent damage to cable 7 by preventing the cable from bending too sharply. Each of the one, or more, groves 20 that the positioner 10 may define, transitions from bore 16 to the respective grove, or grooves, along a corresponding flared transitional region 21, that may, or may not, form a bend radius.

The at least one groove 20 can comprise a means for holding at least a portion of the cable in a fixed position that is at an angle with respect to the longitudinal axis of the body 12. At least a portion of the at least one groove 20 can have, in one aspect, a cross-sectional area greater than the cross-sectional area of at least a portion of cable 7 coupled to connector 5. In another aspect, the at least one groove can be sized such that the portion of cable 7 positioned in the at least one groove 20 of body 12 is retained by a tab, or lip, defined in a distal end surface 15 of the distal end 14 of the body. Thus, in this aspect, the portion of the cable 7 positioned in at least a portion of the at least one groove 20 can be substantially contained, and retained, in the at least one groove. In another aspect, at least a portion of the at least one groove 20 can be half-circular in cross-sectional shape. In still another aspect, at least a portion of the at least one groove can have a cross-sectional area smaller than the cross-sectional area of the cable of a connector that will be positioned in the groove. In this aspect, friction between cable 7 and the portion having the smaller cross sectional area can hold in a fixed position the cable such that the axis of the cable forms an angle with the longitudinal axis of the body 12.

In yet another aspect, positioned 10 can define at least one tab, or lip, 24 along at least a portion of the at least one groove 20, wherein the at least one tab protrudes into a portion of the at least one groove. As illustrated in FIGS. 1B and 1C, body 12 defines the at least one tab, or lip, 24, extending dimensional amount 34, along at least a portion of the peripheral edge 18 of the distal end 14 of the body. The at least one tab/lip 24 can pinch, or otherwise secure, at least a portion of cable 7 so that at least a portion it can be held in a fixed position that forms an angle with respect to the longitudinal axis 36 of the body 12. In still another aspect, the at least one tab 24 can comprise a pair of opposing tabs. The pair of opposing tabs 24 can be spaced from each other a distance that is less than the diameter of the cable. In this aspect, a portion of cable 7 can be urged (typically by pushing with one's fingers) between the pair of opposing tabs 24, and the pair of opposing tabs can cooperate to secure at least a portion of the cable 7 in a fixed position so that the cable axis forms an angle with respect to the longitudinal axis 36 of the body.

In one aspect, and as illustrated in FIG. 1A, the connector cable positioner 10 can comprise a plurality of grooves 20. In another aspect, the distal end of body 12 may define a first pair of grooves 20 orthogonal to the longitudinal axis of the body. In yet another aspect, the distal end of body 212 may also define a second pair of grooves 20 having an axis perpendicular to the axis of the first pair of grooves. In use, as will be described more fully below, a user can choose to insert a portion of the cable into any of the plurality of grooves.

In one embodiment, positioner 10 can be configured for interaction with OBD connector 5, as illustrated in FIG. 2A. In one aspect, positioner 10 can be formed integrally with an OBD connector. In another aspect, the positioner 10 can be shaped and sized so that positioner 10 fits over an OBD connector. In this aspect, positioner 10 can be formed as an overmold configured to matingly engage the OBD system connector 5. In yet another aspect, as illustrated in FIGS. 2A and 3, and as discussed previously, body 12 of positioner 10 can be formed in a variety of sizes. In this aspect, when positioner 10 is used with an OBD connector, the combination of the positioner and connector 5 can complementarily engage different sized OBD scan tools.

With reference to FIG. 2A, positioner 10 can be assembled to comprise any or all of the components and aspects as described above. In one aspect, if positioner 10 is formed integrally with the connector, no assembly of the connector to the positioned will be required. In another aspect, if positioner 10 is not formed integrally with connector 5, cable 7 of the connector can be inserted through bore 16 in the positioner starting from proximal end 13 of body 12 of positioner 10. The proximal end of the body can be inserted onto connector 5 and can matingly engage connector 5. In one aspect, the body 12 can be secured to connector 5 with a friction fit. In another aspect, body 12 can be secured to the connector 5 with, for example, adhesives, tapes, and the like.

In use, connector 5 with positioner 10 attached to it, or formed therewith, can be installed and/or used to make a connection as needed. In the case of an OBD connector, this typically will be under the dashboard of a vehicle. At least a portion of cable 7 attached to the connector can be inserted into the at least one groove 20 of positioner 10 before, or after, the connector has been installed. In one aspect, the portion of the at least one groove 20 having a cross-sectional area smaller than the cross-sectional area of cable 7 of connector 5 can hold the cable in a fixed position. In another aspect, and as described above, at least one tab 24 can reduce the cross-sectional area of the at least one groove 20. In this aspect, the cable can be inserted into the at least one groove 20 by urging the cable past the at least one tab 24. The cable can be inserted into any of the at least one groove that the user desires in order to minimize the obtrusiveness of the cable and/or to route the cable in a desired direction. For example, the connector cable positioner can hold the cable of an OBD connector 5 so that the cable does not interfere with the driver of a vehicle in which the OBD connector and the connector cable positioner are installed.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. For example, the concepts shown in the figures with respect to the preferred embodiment may also be used with audio, video, computer, communications, power, and other electronic and electrical equipment cables. In another embodiment, rather than, or in addition to, the body defining grooves, the body can define one, or more, split rings. The split rings may be formed on, or attached to, the distal end of the body and may be formed from a material that is flexible enough to allow a cable to expand the ring as a cable is pushed through the split in the ring, yet rigid and resilient enough so that the split in the ring(s) springs back together after the cable is surrounded by the ring(s). In the groove/tab embodiment, the cable deforms more than the tabs as the cable is pushed through the tabs into the groove, whereas with the split rings, the rings substantially deform with respect to the cable at the split as the cable is pushed through the split in the ring. Moreover, although specific terms are employed herein, as well as in the claims which follow, they are used only in a generic and descriptive sense, and not for the purposes of limiting the described invention, nor the claims which follow.

What is claimed is:

1. A cable positioner configured for engaging a connector having a cable attached thereto, the positioner comprising:

a body having a proximal end, an opposed distal end, and a longitudinal axis, the body further defining a bore, which has a proximal end corresponding to the proximal end of the body and a distal end corresponding to the distal end of the body, the distal end of the body extending past the distal end of the bore in a direction away from the proximal end of the body, the bore being substantially parallel with the longitudinal axis, the bore being configured for receiving a portion of the cable, wherein the body further defines at least one groove in a portion of the distal end that extends, substantially perpendicularly with respect to the longitudinal axis, between the distal end of the bore and a peripheral edge of the distal end of the body, wherein the body defines a transitional region that flares outwardly and away from the distal end of the bore and starts the groove, and wherein the means for holding at least a portion of the cable in a fixed position is at least one tab that protrudes into the at least one groove.

2. The positioner of claim 1, wherein the at least one tab is formed along at least a portion of the peripheral edge of the distal end of the body.

3. The positioner of claim 1, wherein the at least one tab comprises a pair of opposing tabs, wherein the pair of opposing tabs are spaced apart from each other a distance that is less than the diameter of the cable.

4. The positioner of claim 1, wherein at least a portion of the cable is pinched by the at least one tab.

5. The cable positioner of claim 1 wherein each at least one groove comprises a means for holding at least a portion of the cable in a fixed position at an angle with respect to the longitudinal axis of the body, and wherein the means for holding is a tab.

* * * * *